US012342871B2

(12) United States Patent
Bologna et al.

(10) Patent No.: US 12,342,871 B2
(45) Date of Patent: Jul. 1, 2025

(54) CHARGER DOOR COVER WITH EXTENDED FEATURES

(71) Applicant: PHILIP MORRIS PRODUCTS S.A., Neuchâtel (CH)

(72) Inventors: Matteo Bologna, Lausanne (CH); Ricardo Cali, Mannheim (DE); Audrey Cally, Soral (CH); Marc A. F. Van Den Boogaart, Giez (CH); Vincent Ducret, Yverdon (CH); Christina Evgenia Katsi, Lausanne (CH)

(73) Assignee: Philip Morris Products S.A., Neuchâtel (CH)

( * ) Notice: Subject to any disclaimer, the term of this patent is extended or adjusted under 35 U.S.C. 154(b) by 483 days.

(21) Appl. No.: 17/642,529

(22) PCT Filed: Sep. 1, 2020

(86) PCT No.: PCT/IB2020/058137
§ 371 (c)(1),
(2) Date: Mar. 11, 2022

(87) PCT Pub. No.: WO2021/048692
PCT Pub. Date: Mar. 18, 2021

(65) Prior Publication Data

US 2022/0322752 A1 Oct. 13, 2022

(30) Foreign Application Priority Data

Sep. 13, 2019 (EP) ..... 19386038

(51) Int. Cl.
*A24F 40/95* (2020.01)

(52) U.S. Cl.
CPC ..... *A24F 40/95* (2020.01)

(58) Field of Classification Search
CPC ..... A24F 40/95; A24F 15/01; A24F 15/015
See application file for complete search history.

(56) References Cited

U.S. PATENT DOCUMENTS

| | | | | |
|---|---|---|---|---|
| 9,864,947 | B1 | 1/2018 | Sur et al. | |
| 9,936,733 | B2 | 4/2018 | Ampolini et al. | |
| 9,961,985 | B2 * | 5/2018 | Shigeno | A61C 17/224 |
| 10,080,387 | B2 | 9/2018 | Philips | |
| 11,133,687 | B2 * | 9/2021 | Spyrison | H02J 7/02 |

(Continued)

FOREIGN PATENT DOCUMENTS

| | | | |
|---|---|---|---|
| JP | H11507718 | A | 12/1996 |
| JP | 2016-508370 | A | 3/2016 |

(Continued)

OTHER PUBLICATIONS

Extended European Search Report for EP 193860384.4 issued by the European Patent Office on Mar. 26, 2020; 8 pgs.

(Continued)

*Primary Examiner* — Truc T Nguyen
(74) *Attorney, Agent, or Firm* — Mueting Raasch Group

(57) ABSTRACT

A cover for a device-holder portion of a charging case including a coupler and a storage portion. The coupler may be operable to releasably retain the cover to an external wall of the device-holder portion. The storage portion may define a storage volume in the cover for storing at least one item.

19 Claims, 11 Drawing Sheets

(56) References Cited

U.S. PATENT DOCUMENTS

| | | | | |
|---|---|---|---|---|
| 11,728,664 | B2 * | 8/2023 | Holzherr | H02J 7/0045 131/329 |
| 2010/0313901 | A1 * | 12/2010 | Fernando | B65D 85/1081 131/330 |
| 2014/0014125 | A1 * | 1/2014 | Fernando | H01M 10/0525 131/328 |
| 2015/0020825 | A1 | 1/2015 | Galloway | |
| 2015/0122252 | A1 | 5/2015 | Frija | |
| 2015/0366264 | A1 | 12/2015 | Theron | |
| 2017/0020191 | A1 | 1/2017 | Lamb et al. | |
| 2019/0320716 | A1 * | 10/2019 | Seidenfeld | A24F 40/95 |
| 2020/0249360 | A1 * | 8/2020 | Majercak | G01S 19/34 |
| 2020/0299030 | A1 * | 9/2020 | Fromme | B65D 1/06 |
| 2021/0083711 | A1 * | 3/2021 | Miles, Jr. | H04M 1/185 |
| 2021/0204664 | A1 * | 7/2021 | Fromme | A45F 5/00 |
| 2022/0228707 | A1 * | 7/2022 | Ng | F16M 11/041 |
| 2023/0079366 | A1 * | 3/2023 | Lee | A24F 40/42 131/329 |
| 2023/0113936 | A1 * | 4/2023 | Prestia | A24F 40/40 131/328 |
| 2023/0144523 | A1 * | 5/2023 | Bouchuiguir | A24F 40/95 131/329 |

FOREIGN PATENT DOCUMENTS

| | | | | |
|---|---|---|---|---|
| JP | 2016-537016 | A | 12/2016 | |
| JP | 3212811 | U | 10/2017 | |
| KR | 101186917 | B1 | 10/2012 | |
| KR | 20170025723 | * | 3/2017 | H04M 1/0202 |
| WO | WO 96/39879 | A1 | 12/1996 | |
| WO | WO 2014/122200 | A1 | 8/2014 | |
| WO | 2015088744 | A1 | 6/2015 | |
| WO | 2018202732 | A1 | 11/2018 | |
| WO | WO 2019/053230 | A1 | 3/2019 | |

OTHER PUBLICATIONS

International Search Report and Written Opinion for PCT/IB2020/058137 issued by the European Patent Office on Nov. 17, 2020; 15 pgs.

International Preliminary Report on Patentability for PCT/IB2020/058137 issued by the European Patent Office on Jan. 14, 2022; 29 pgs.

Japanese Office Action for JP 2022-513456 issued by the Japanese Patent Office on Jul. 23, 2024; 8 pgs. including English translation.

* cited by examiner

CHARGER DOOR COVER WITH EXTENDED FEATURES

This application is the § 371 U.S. National Stage of International Application No. PCT/IB2020/058137, filed 1 Sep. 2020, which claims the benefit of European Application No. 19386038.4, filed 13 Sep. 2019, the disclosures of which are incorporated herein by reference.

The present invention relates to a charging case for receiving an aerosol generating device and particularly to a cover for a device-holder portion of a charging case. The cover includes a storage volume for storing an item.

Charging cases generally include a pivotable opening configured to releasably hold an aerosol-generating device with a cover, in other words, a charger door cover. Typically, the cover is a solid body to simply retain the aerosol-generating device in the charger.

In some systems, the aerosol-generating device is configured to receive an aerosol-generating article comprising a solid aerosol-forming substrate, such as a gathered, crimped sheet of tobacco. In these systems, the device typically comprises an atomiser, which is arranged to heat the aerosol-forming substrate when the article is received in the device. The aerosol-generating article may also comprise a filter, which is wrapped together with the aerosol-forming substrate in the form of a rod, similar to a conventional cigarette. In other systems, the device is configured to receive a cartridge comprising an atomiser and a liquid aerosol-forming substrate. Such cartridges are often referred to as cartomisers. Common types of atomiser used in cartomisers comprise a coil of heater wire wound around an elongate wick soaked in liquid aerosol-forming substrate.

Some electrically operated aerosol-generating systems comprise a case for releasably holding the aerosol-generating device when not in use. Such cases may provide a degree of protection for the aerosol-generating device and may also provide additional functions such as recharging and refilling with aerosol-forming substrate.

Cases for holding aerosol-generating devices often comprise housings defining narrow openings into which a user is required to insert the device. The narrow openings typically have a width similar to the width of the aerosol-generating device. Users inserting an aerosol-generating device into these cases are generally required to closely align the aerosol-generating device with the narrow opening to insert the device into the case. This can be difficult for users, especially in low light or when the user is moving.

It would be desirable to provide a solution for adapting covers or a charger door cover to provide functionality for a variety of different users of the charging case. It would be desirable to provide a charger door cover that can contain and optionally charge an aerosol-generating device.

According to this disclosure, there is provided a cover for a device-holder portion of a charging case, the cover comprising a coupler and a storage portion. The coupler is operable to releasably retain the cover to an external wall of the device-holder portion. The storage portion defines a storage volume in the cover for storing at least one item.

According to this disclosure, there is provided a cover for an external wall of a device-holder portion of a charging case, the cover comprising a coupler and a storage portion. The coupler is configured to releasably retain the cover to the external wall of the device-holder portion. The storage portion defining a storage volume in the cover for storing at least one item According to this disclosure, there is provided a charging case for receiving and charging an aerosol-generating device, the case comprising a housing, a device-holder portion, and a cover. The housing has an opening. The device-holder portion is moveably coupled to the housing and moveable relative to the housing between an open position and a closed position. The device-holder portion may be pivotally coupled to the housing. The device-holder portion comprises an external wall and one or more internal walls arranged to releasably hold an aerosol-generating device. The cover comprises a storage portion, and the cover is retained to an external wall of the device-holder portion. The storage portion defines a storage volume in the cover for storing at least one item. Preferably, the cover comprises a coupler arranged to releasably retain the cover to the external wall.

According to this disclosure, there is provided a kit comprising a charging case. The case comprising a housing, a device-holder portion, and a cover. The housing has an opening. The device-holder portion is moveably coupled to the housing and moveable relative to the housing between an open position and a closed position, the device-holder portion comprising an external wall and one or more internal walls arranged to releasably hold an aerosol-generating device. The cover comprises a coupler and a storage portion. The coupler is operable to releasably retain the cover to an external wall of the device-holder portion. The storage portion defines a storage volume in the cover for storing at least one item. The device-holder portion may be moveably coupled to the housing, and moveable relative to the housing between an open position and a closed position.

Providing a cover with a storage portion as described above provides improved functionality of a charging case since the storage portion can accommodate various items. For example, the storage portion can accommodate an aerosol-generating device thereby allowing a charging case to accommodate at least two aerosol-generating devices. This may enable the charger to contain and optionally charge two aerosol-generating devices at the same time. Alternatively, the storage portion may provide a device that can accommodate customizable displays or other electronics. Displays and electronics may enable functionality for a variety of different users, for instance to meet the demands of visually impaired users without producing a charging case specifically for such users. Other electronics may include biometric sensors that may allow for a charging case with security features and prevent access to a minor.

Preferably, the storage portion is configured to receive and store an aerosol-generating device within the storage volume.

Preferably, the cover comprises a lid having an open position and a closed position. The lid may be configured to expose the storage volume when in the open position. The lid may also be configured to cover the storage volume in the closed position. Furthermore, the lid may be configured to pivot between the open position and the closed position. Alternatively, the lid may pivot about a hinge. Preferably, the cover further comprises a bottom wall and one or more side walls. The bottom wall may comprise the coupler and the one or more side walls may extend from a surface of the bottom wall. Furthermore, the lid may be coupled to at least one of the one or more side walls such that the storage volume is defined between the bottom wall, the one or more side walls, and the lid when the lid is in the closed position.

Preferably, the storage portion is configured to receive electronic circuitry. Preferably, the cover further comprises an electronic coupler operable to electrically couple the electronic circuitry to the case when the electronic circuitry is received in the storage portion. Preferably, the cover is electrically coupled to the charging case when retained to the external wall of the device-holder portion. Preferably, the electronic circuitry is operable to electrically couple the cover to the charging case when the cover is retained to the external wall of the device-holder portion.

Preferably, the cover further comprises an at least partially transparent wall adjacent the storage portion. The storage portion may be configured to receive a visual display, or an electronic display.

Preferably, the storage portion is configured to receive a tactile display. Preferably, the storage portion is configured to receive aerosol-generating articles or aerosol-generating device accessories.

The coupler may comprise a magnetic material for coupling to a magnet of the charging case. The coupler may comprise a mechanical interface, such a clip, for coupling to a corresponding mechanical interface of the charging case. Preferably, the coupler comprises a first magnetic coupler and a second magnetic coupler offset at a distance from one another. The first and second magnetic couplers may comprise magnetic material. For instance, the magnetic material may be iron, nickel, cobalt, or other materials that may become magnetized or be magnetically attracted to magnets. In another example, the magnetic material may be a magnet. The first magnetic material may be positioned towards a proximal end of the cover and the second magnetic material may be positioned towards a distal end of the cover.

The distance between the center of the first magnetic coupler and the center of the second magnetic coupler may be in a range from about 60 mm to about 70 mm. Preferably, the distance between the center of the first magnetic coupler and the center of the second magnetic coupler is about 60 mm to 70 mm. Preferably, the distance between the center of the first magnetic coupler and the center of the second magnetic coupler is about 65 mm. The first magnetic coupler or the second magnetic coupler may be in a range from about 5 mm to about 15 mm wide. Preferably, the first magnetic coupler or the second magnetic coupler is about 10 mm wide. The first magnetic coupler or the second magnetic coupler may have a circular shape. The diameter of the first magnetic coupler or the second magnetic coupler may be in a range of about 5 mm to about 15 mm. Preferably, the diameter of the first magnetic coupler or the second magnetic coupler is about 10 mm. The first magnetic coupler and the second magnetic coupler may extend outwardly from the cover in order to be received within a corresponding recess in the charging case. The first magnetic coupler and the second magnetic coupler may be positioned within a recess in the cover in order to receive a corresponding protrusion of the charging case. Thus, it is possible for the cover to be secured to the charging case in a stable manner.

Preferably, the storage portion comprises a storage volume in the cover having a width in a range from about 10 mm to about 15 mm. Preferably, the storage volume in the cover has a width of about 14 mm. Preferably, the storage volume in the cover has a length in a range from about 90 mm to about 100 mm. Preferably, the storage volume in the cover has a length of about 92 mm. Preferably, the storage volume in the cover has a depth in a range from about 10 mm to about 15 mm. Preferably, the storage volume in the cover has a depth of about 14 mm. Preferably, the storage volume is polyhedral shaped.

Preferably, the cover further comprises an open end configured to receive at least a portion of an aerosol-generating device into the storage portion. Preferably, the cover further comprises a closed portion configured to releasably hold the at least a portion of the aerosol-generating device when received in the storage portion. Preferably, the closed portion is at an end of the cover.

Preferably, the charging case according comprises a coupler operable to releasably retain the cover to the external wall of the device-holder portion. The coupler may comprise a single magnet. Alternatively, the coupler of the case may comprise a first magnet and a second magnet offset at a distance from one another. The charging case may further comprise at least one power channel arranged to provide electrical power to electronic circuitry in the cover. The charging case may still further comprise at least one data channel arranged to provide transmit or receive data to or from electronic circuitry in the cover.

The cover may comprise an electronic coupler operable to electrically couple to the charging case. The electronic coupler may be configured to receive power from the charging case. The electronic coupler may be electrically coupled to the charger case using any suitable wired or wireless connection. The electronic coupler may couple to the charging case through the external wall of the device-holder. The electronic coupler may be operable to receive power from the charging case. The electronic coupler may be operable to transmit data to or receive data from the charging case.

Preferably, the kit further comprises one or more aerosol-generating devices.

Advantageously, covers that include a storage portion as described herein may provide a simple way to add features to charging cases without the need for dissembling the charger. As a result, charging cases may be easily customized. Furthermore, the same charger may be used to provide different functionalities by swapping out one cover with a particular functionality for a second cover with a different functionality. Still further, the cover may provide additional functionality that is easy to produce and repair. Additionally, the covers may provide a product that may be easier to update to new standards, trends in electronics, or increase the functionality of the charging case for a user thereby increasing user satisfaction.

According to this disclosure, there is provided a cover for a device-holder portion of a charging case, the cover comprising a storage portion fixed to an external wall of the device-holder portion. The storage portion defines a storage volume in the cover for storing at least one item. In various embodiments, the cover fixed to the external wall of the device-holder portion includes the additional features described above.

Advantageously, the storage portion of the covers may be configured to receive electronics including biometric sensors, displays, wired communication devices, wireless communication devices, charging devices, data storage devices, or aerosol-generating devices.

As used herein, the term "aerosol generating article" is used herein to denote an article wherein an aerosol generating substrate is heated to produce and deliver inhalable aerosol to a consumer. As used herein, the term "aerosol generating substrate" denotes a substrate capable of releasing volatile compounds upon heating to generate an aerosol.

As used herein, the term "aerosol-generating device" refers to a device comprising a heater element that interacts with the aerosol generating substrate of the aerosol generating article to generate an aerosol.

As used herein, the term "charging case" refers to a case capable of receiving an aerosol-generating device and charging a battery the aerosol-generating device. The charging case may include a housing and a device-holder portion. The housing may generally form the shape of the charging case.

The device-holder portion may be configured to receive the aerosol-generating device. The device-holder portion may include an external wall capable of being coupled to a cover. The external wall of the device-holder portion may be a surface that faces away from the charging device housing. In other words, the external wall of the device-holder portion may define an external surface of the charging case when a cover is not attached.

The cover may include a coupler and a storage portion. The coupler may be configured to releasably retain the cover to an external wall of the device-holder portion. The storage portion may define a storage volume in the cover for storing at least one item. The storage portion may be outside of the charging case when releasably retained to the external wall of the device-holder portion. In other words, the cover may reside outside of the housing of the charging case when coupled to the device-holder portion. Furthermore, the cover may not extend into a housing of the charging case when coupled to the device-holder portion and the device-holder portion is in a closed position. Advantageously, the cover may provide add-on storage to the charging case without modifying the housing of the charging case. This add-on storage may be customized by the user and easily modified to suit the users needs.

As used herein, the term "storage volume" refers to a volumetric space defined within the cover that may include a recess in the cover or a portion of the cover that is able to receive or house an item. Items that may be stored or received in the storage portion may include one or more of, for example, aerosol-generating devices, aerosol-generating articles, accessories, or electronics. The term "accessories" refers to articles and devices for aerosol-generating devices or charging cases such as, for example, charging cables, cleaning articles or tools, or trays for used aerosol-generating articles.

The main body of the cover may define a long oval shape. The ends of the cover may be rounded. The bottom of the cover may be flat to fit tightly against a charging case. The cover may further include one or more couplers comprising a magnetic material that may provide a strong and stable separable connection. The storage portion may be located in the middle of the cover. The storage portion may have a rectangular cross-sectional area. The storage portion may have a length in a range from about 90 mm to about 105 mm, a width in a range from about 10 mm to about 20 mm, and a depth in a range from about 10 mm to about 20 mm.

The cover may be capable of receiving electronics in the storage portion. The storage portion may be capable of receiving electronics such as, for example, a near-field communication (NFC) device, a Bluetooth device, a wireless charging device, a reverse wireless charging device, a radio-frequency identification (RFID) device, a Wireless Fidelity (WiFi) device, an inductively chargeable battery, a data storage device, or displays. The cover may include, for example, electronic couplers that may be incorporated into the couplers. The electronic couplers may enable electronics received in the cover to operatively couple to electronics of the charging case. The electronic couplers may provide electronic power and signal coupling.

The cover may further include connector springs on one or more walls that define the storage portion. The electronic couplers may provide an electrical coupling between the connector springs. The connector springs may apply a force on inserted electronics to ensure a tight seating when the cover is detached from the charging case. The connector springs may act as an electrical contact point for electrical contacts of electronics received in the storage portion of the cover.

Electronics may include a housing, electronic circuitry, electronic couplers, and electronic contacts. The electronic circuitry may have a board on chip design and may include any suitable electronics such as, for example, sensors, chips, power storage, passive electrical components, processors, or controllers. The electronic couplers may extend through the housing from the electronic circuitry to the electronic contacts to operatively couple the electronic circuitry to external devices such as, for example, the electronic couplers of the cover or electronics of a charging case. The electronic circuitry may communicate, receive power, or provide power via the electronic couplers and electronic contacts.

Electronics such as RFID, NFC, or WiFi devices may enable the electronic circuitry to communicate with other devices. An RFID device may act as a key to open doors, like a wallet to perform payments, or may be used to interact with services over the internet. Electronics such as a wireless charging device or a reverse charging device may enable the electronic circuitry to charge a charging case inductively or enable an attached charging case to charge another portable device such as for example, a smartphone, inductively (for example, reverse charging). Electronics such as data storage may enable the electronic circuitry to receive or send data for the charging case such as for example, updating the firmware, setting up the user preferences for the charging case or tracking behaviour of the user. If the electronics are not inserted to the cover, the storage portion may be used to store aerosol-generating articles or accessories.

The cover may include a surface that may be at least partially transparent. In other words, the cover may include a surface that may be translucent. The term "transparent" refers to the nature of a material or article to allow visible light to pass through it so that objects behind it may be seen by a consumer of the device. The at least partially transparent surface may allow electronics received in the cover to further include electronics such as, for example, light emitting displays, reflective displays (for example, electronic ink displays), biometric sensors, or optical sensors. The at least partially transparent surface may allow the displays to be seen through the cover without be exposed. Additionally, the at least partially transparent surface allows biometric sensors or optical sensors to work without being exposed. The at least partially transparent surface provides protection from damage, dust, liquids, contaminants, and other hazards while still allowing the electronics to function properly. The at least partially transparent surface may allow an inactive display to remain hidden below the at least partially transparent surface. An activated display may be visible through the at least partially transparent surface. The at least partially transparent display may have a total transmittance of about 50 percent and about 100 percent. Preferably the at least partially transparent display may have a total transmittance of about 100 percent, or at least about 90 percent, or at least about 80 percent, or at least about 70 percent, or at least about 60 percent, or at least about 50 percent.

The storage portion of the cover may receive a reflective display. The reflective display may include electrophoretic, electro wetting, electronic ink or other reflective display technologies. The reflective display can have cover-pigment particles and contrast-pigment particles that may rotate when a very low voltage is applied. Voltages may be applied to the reflective display to form information, a pattern, or a picture. The at least partially transparent surface may allow light to reflect off the reflective display to allow the user to see the information, patterns, or pictures formed on the reflective display. Alternatively, a light emitting display may be used. The light emitting display may be any suitable display such as, for example, a liquid crystal display (LCD), light emitting diode (LED) displays, organic light emitting diode (OLED) display, for example. The at least partially transparent surface may allow light from the light emitting display to pass through the surface of the cover to allow the user to see the display.

The cover may include an opening at a top surface that may allow a user to touch a surface of electronics that may be inserted in the cover. The top surface may face away from the charging case when the cover is attached to such. The opening may have a smaller are than the electronics in order to ensure a tight seating and to prevent the electronics from sliding through the opening. The surface of the electronics may have a matrix of moveable pins providing a tactile display. Said moveable pins can be moved upwards to create an elevation that a user can perceive through touch. The moveable pins may be selectively moved to convey messages in braille or provide tactile images to the user.

Additionally, a lid may be coupled to the top surface that may be pivotable between an open position and a closed position. In the open position the surface of the electronics may be exposed allowing the user to touch the surface of the electronics. In the closed position the lid may cover the electronics protecting the electronics from damages, dust, debris, contaminants, for example. The lid may be pivotally coupled to the top surface via a hinge.

The storage portion may generally be shaped for storing an aerosol-generating device. The cover may include an access point or opening at the top surface that is configured to receive at least a portion of the aerosol-generating device into the storage portion. The aerosol-generating device may be slidably received into the storage portion. The aerosol-generating may be inserted "upside-down" device from being exposed to dust and other contaminants. In other words, the aerosol-generating device may be inserted with an end of the aerosol-generating device with the opening for aerosol generating articles down into the storage portion or slot, thus leaving a connector end at an open top end of storage portion.

The cover may include a lid configured to cover the access point or opening in the top surface. The lid may be pivotable between an open position and a closed position. In the open position the storage volume may be exposed, and the aerosol-generating device, or any other devices or accessories, may be inserted or removed from the storage portion. In the closed position, the lid is configured to cover the storage volume protecting any contents of the storage portion from dust, liquid, debris, or other contaminants. The lid may be coupled to the top surface via a hinge.

The storage portion may further include a bottom wall and one or more side walls extending from a surface of the bottom wall. The lid may be coupled to the one or more side walls such that the storage volume is defined between the bottom wall, the one or more side walls, and the lid when the lid is in the closed position. The lid may be coupled to the one or more side walls via the hinge. The lid may be replaceable or interchangeable.

The storage portion may be configured to hold or receive an aerosol-generating device, aerosol-generating articles, accessories, for example. This may enable the charging case to receive at least 2 aerosol-generating devices. Additionally, this may enable the charging case to charge at least 2 aerosol-generating devices. Alternatively, the storage portion may be configured to store a power-bank for carrying extra energy to give an attached charging case additional energy storage or to recharge the charging case.

In one embodiment, the cover may be fixed to an external wall of a device-holder portion of a charging case. In other words, the cover may be integrally formed with the device-holder portion. In this embodiment, the cover may not be releasably retained to the charging case. The cover fixed to the external wall may include a storage portion as described herein. For example, the cover fixed to the external wall may include a storage portion configured to receive an aerosol-generating device, a power-bank, or electronics. The cover fixed to the external wall may further include a bottom wall and one or more side walls extending from a surface of the bottom wall. The lid may be coupled to the one or more side walls such that the storage volume is defined between the bottom wall, the one or more side walls, and the lid when the lid is in the closed position. The lid may be coupled to the one or more side walls via the hinge. The lid may be replaceable or interchangeable.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

Figure 1:
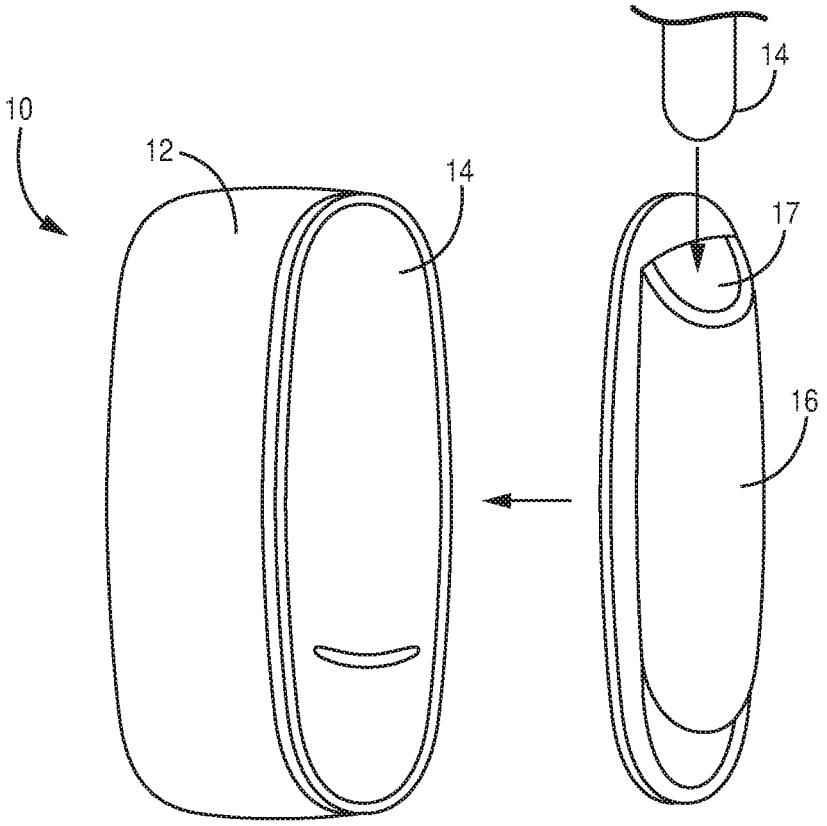
FIG. 1 is a schematic diagram of a charging case in a closed position with releasable covers.

The covers for a device-holder portion of a charging case depicted in FIGS. 1-11 illustrate one or more embodiments of covers described above. The schematic drawings are not necessarily to scale and are presented for purposes of illustration and not limitation. The drawings depict one or more aspects described in this disclosure. However, it will be understood that other aspects not depicted in the drawings fall within the scope and spirit of this disclosure.

The charging case depicted in FIG. 1 illustrates a charging case 10 that includes a main body 12, a releasable cover 14, and a cover 16 with extended features. The charging case 10 may receive an aerosol-generating device within the main body 12 and charge such devices received therein. The cover 14 may be releasably attached to a holder (not shown) of the charging case 10. The cover 14 may be removed and from the charging case 10 and replaced with the cover 16 with extended features. The cover 16 may include a storage volume with an opening 17. The cover 16 may accommodate an aerosol-generating device within the storage volume such as, for example, aerosol-generating device 18. The aerosol-generating device 18 may be received through the opening 17. Once the aerosol-generating device 18 has been received through the opening 17, the aerosol-generating device 18 abuts against a closed portion of the cover 16 which in this example is a closed end of the cover 16. The closed end may releasably hold at least a portion of the aerosol-generating device 18 when received in the cover 16. For instance, there may be a magnet in the closed end for releasably holding the aerosol-generating device 18.

Figure 2A:
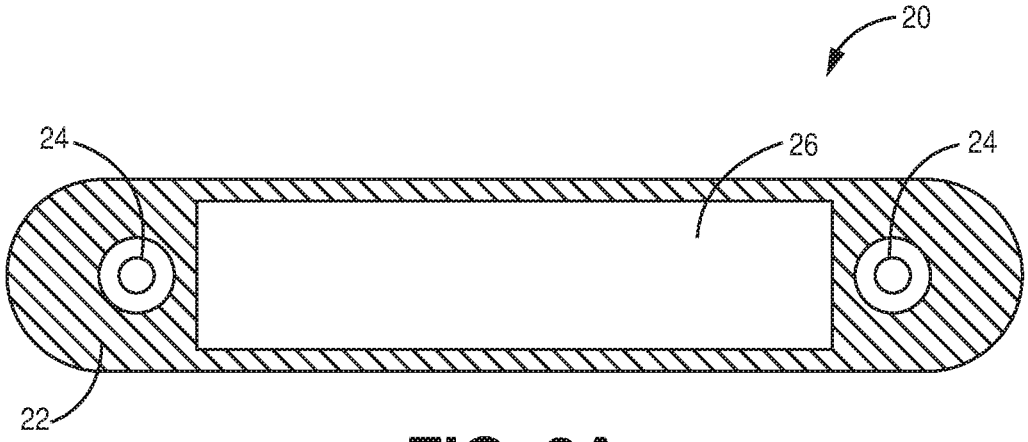
FIGS. 2A-2C are schematic diagrams of a cover for a device-holder portion of a charging case.
Figure 2B:
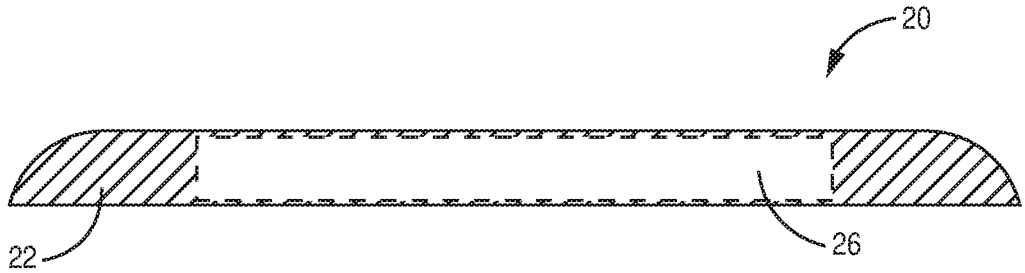
Figure 2C:
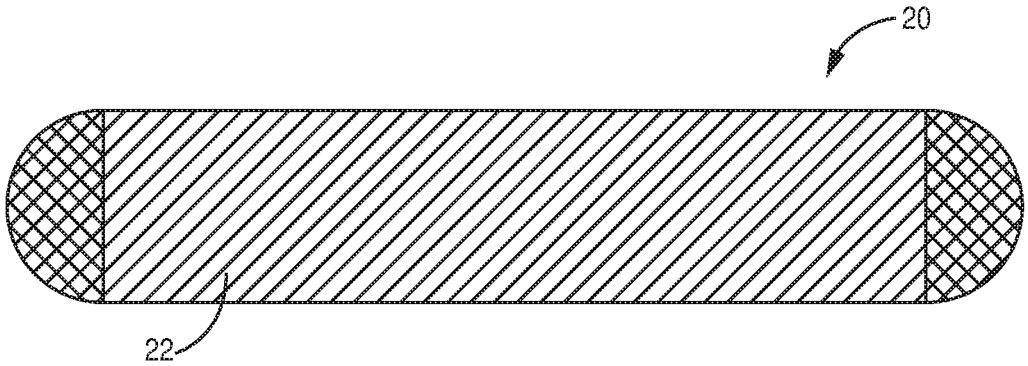

The cover depicted in FIGS. 2A-2C illustrates a cover 20 that includes a main body 22, couplers 24 and a storage portion 26 defining a storage volume. FIG. 2A depicts a bottom view of the cover 20, FIG. 2B depicts a side view of the cover 20, and FIG. 2C depicts a top view of the cover 20. The main body 22 of the cover 20 may have an elongate oval shape. The ends of the cover 20 may be rounded, and the sides of the cover 20 may be approximately straight. The bottom of the cover 20 may be flat to fit tightly against a charging case. The bottom of the cover 20 may be concave in order to fit against a convex surface of a charging case, thus ensuring a secure connection between the cover 20 and the charging case. The bottom of the cover 20 may be convex in order to fit against a concave surface of a charging case, thus ensuring a secure connection between the cover 20 and the charging case. The couplers 24 may provide a strong and stable separable connection. For example, the couplers 24 may include magnetic material to magnetically attach to a charging case. In the middle of the cover 20, there may be a recess, or storage volume, which forms the storage portion 26.

Figure 3A:
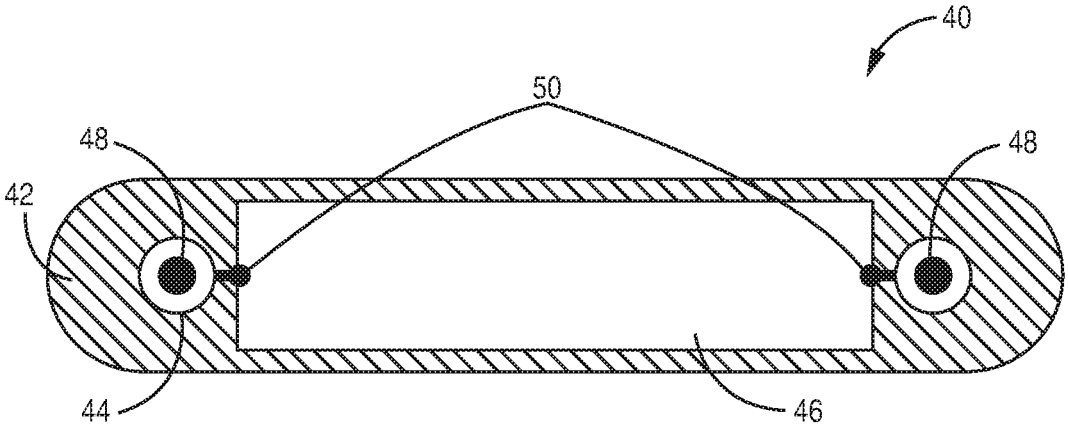
FIGS. 3A-3C are schematic diagrams of another cover for a device-holder portion of a charging case.
Figure 3B:
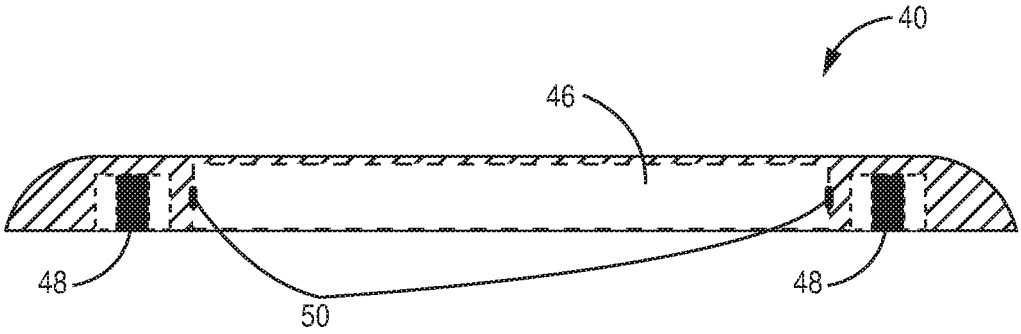
Figure 3C:
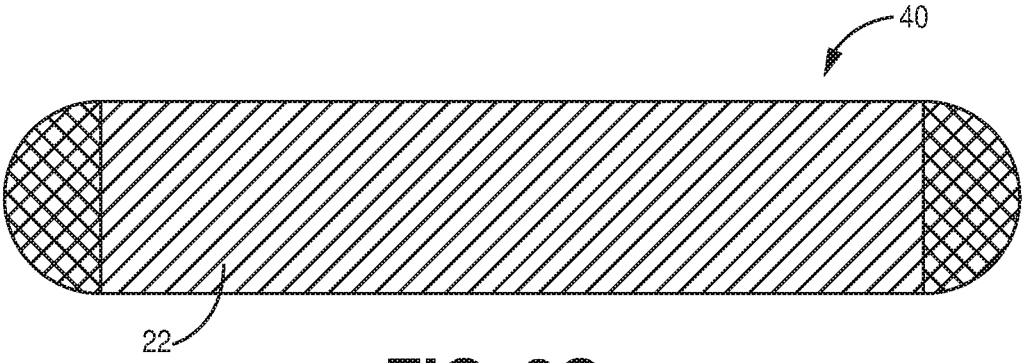

The cover depicted in FIGS. 3A-3C illustrates a cover 40 that includes a main body 42, couplers 44, and storage portion 46 that may be capable of receiving electronics in the storage portion 46. FIG. 3A depicts a bottom view of the cover 40, FIG. 3B depicts a side view of the cover 40, and FIG. 3C depicts a top view of the cover 40. The cover 40 may include electronic couplers 48 that may be incorporated into the couplers 44. The cover 40 may be provided with the electronic couplers 48 to operatively couple with electronics of the charging case. The electronic couplers 48 may provide electronic power or signal coupling. The electronic couplers 48 may provide a physical connection to connector springs 50 located at the inside of the recess that forms the storage portion 46. The connector springs 50 may apply a force on inserted electronics to ensure a tight seating when the cover 40 is detached from the charging case. Suitable electronics for the storage portion 46 may include a near-field communication (NFC) device, a Bluetooth device, a wireless charging device, a reverse wireless charging device, a radio-frequency identification (RFID) device, a Wireless Fidelity (WiFi) device, an inductively chargeable battery, a data storage device, or any other suitable electronics.

Figure 4A:
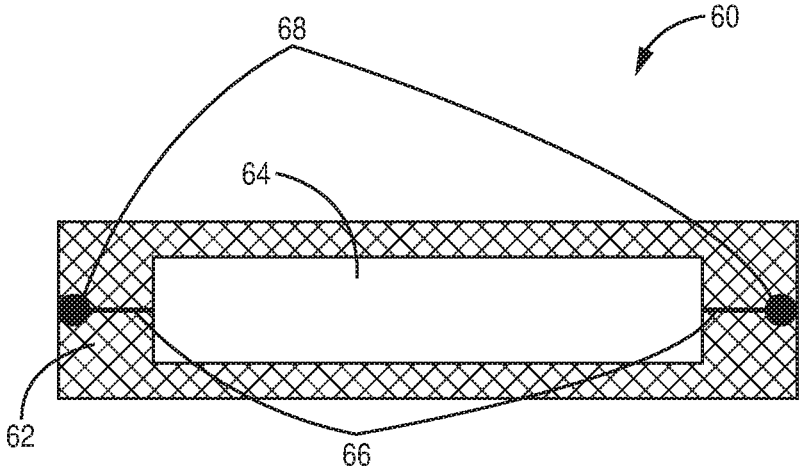
FIGS. 4A and 4B are schematic diagrams of electronics for a cover for a device-holder portion of a charging case.
Figure 4B:
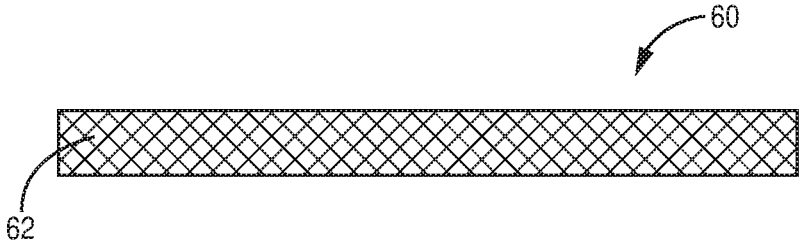
Figure 5:
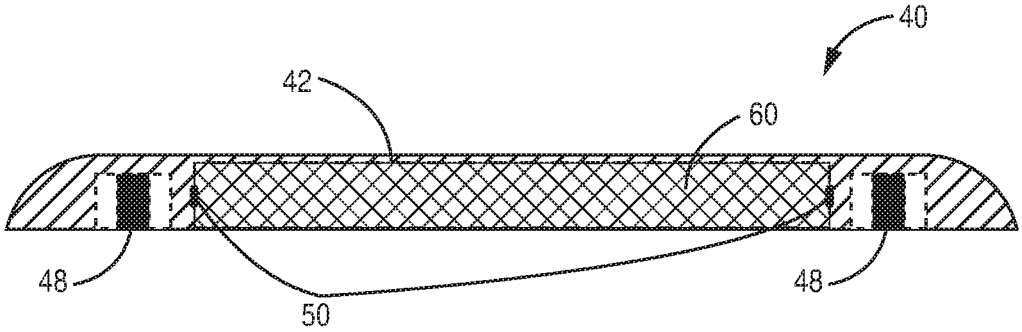
FIG. 5 is a cover for a device-holder portion of a charging case with inserted electronics.

The electronics depicted in FIGS. 4A and 4B illustrates electronics 60 that may be capable of being inserted into a cover (for example, the cover 40 of FIG. 3) as shown in FIG. 5. FIG. 4A depicts a bottom view of the electronics 60 and FIG. 4B depicts a side view of the electronics 60. The electronics 60 may include a housing 62, electronic circuitry 64, electronic couplers 66, and electronic contacts 68. The electronic circuitry 62 may have a board on chip design and may include any suitable electronics such as, for example, sensors, chips, power storage, passive electrical components, processors, controllers, for example. The electronic couplers 66 may extend through the housing 62 from the electronic circuitry 64 to the electronic contacts 68 to operatively couple the electronic circuitry 64 to external devices such as, for example, a cover or a charging case. The electronic circuitry 62 may communicate, receive power, or provide power via electronic couplers 64 and electronic contacts 66.

Electronics such as RFID, NFC, or WiFi devices may enable the electronic circuitry 62 to communicate with other devices. An RFID device may act as a key to open doors, like a wallet to perform payments, or may be used to interact with services over the internet.

Electronics such as a wireless charging device or a reverse charging device may enable the electronic circuitry 62 to charge a charging case inductively or enable an attached charging case to charge another portable device such as for example, a smartphone, inductively (for example, reverse charging).

Electronics such as data storage may enable the electronic circuitry 62 to receive or send data for the charging case such as for example, updating the firmware, setting up the user preferences for the charging case or tracking behaviour of the user.

Figure 6:
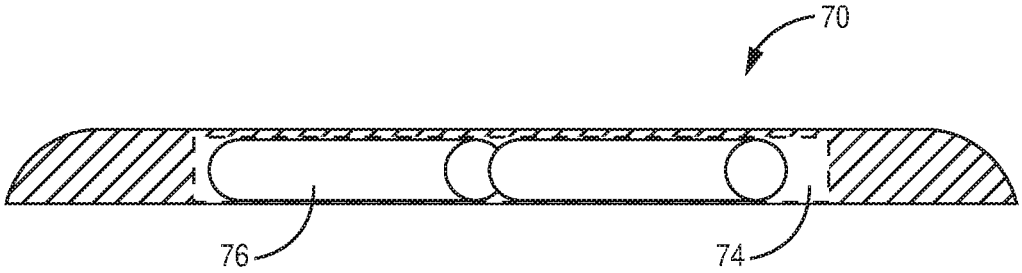
FIG. 6 is a schematic diagram of a cover for a device-holder portion of a charging case with inserted consumables.

If the electronics are not inserted to the cover 70, the storage portion 74 may be used to store aerosol-generating articles or accessories 76 as shown in FIG. 6.

Figure 7A:
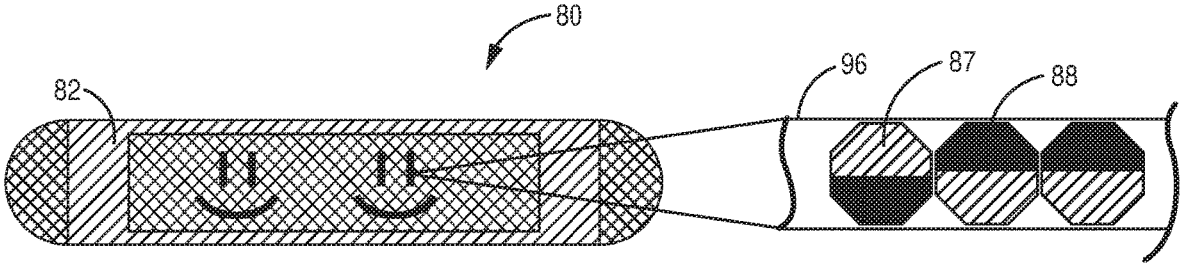
FIGS. 7A and 7B are schematic diagrams of a cover for a device-holder portion of a charging case with an inserted customizable display.
Figure 7B:
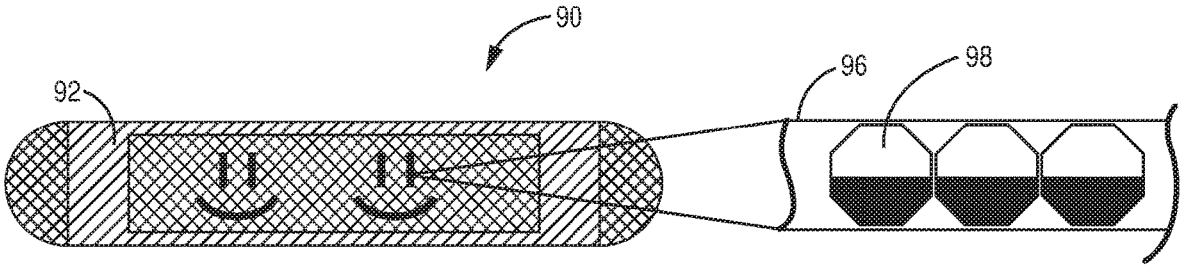

The covers depicted in FIGS. 7A and 7B illustrates covers 80, 90 where a surface of the door may be at least partially or fully transparent. The at least partially or fully transparent surfaces may allow electronics received in the cover to further include electronics such as, for example, light emitting displays, reflective displays (for example, electronic ink displays), biometric sensors, optical sensors, for example.

As depicted by cover 80, the surface 82 may be at least partially transparent. As depicted by cover 90, the surface 92 may be fully transparent. Partially or fully transparent surfaces 82, 92 enable covers 80, 90 to house, or receive, electronics that have a display on a surface of the electronics intended to face the at least partially or fully transparent surfaces. An inactive display can remain hidden below the surfaces. An activated display may visible to the user as shown in FIGS. 7A and 7B.

A reflective display 86 may be used. The reflective display 86 may include electrophoretic, electro wetting, electronic ink or other technologies. The reflective display 86 can have cover-pigment particles 87 and contrast-pigment particles 88 that may rotate when a very low voltage is applied. Voltages may be applied to the reflective display 86 to form information, a pattern, or a picture. Alternatively, a light emitting display 96 may be used. The light emitting display 96 may be any suitable display such as, for example, a liquid crystal display (LCD), light emitting diode (LED) displays, organic light emitting diode (OLED) display, for example. The light emitting display 96 may include one or more pixels 98. A single pixel may include one or more of, for example, an LED, an OLED, a light, a liquid crystal, or a quantum dot.

Figure 8:
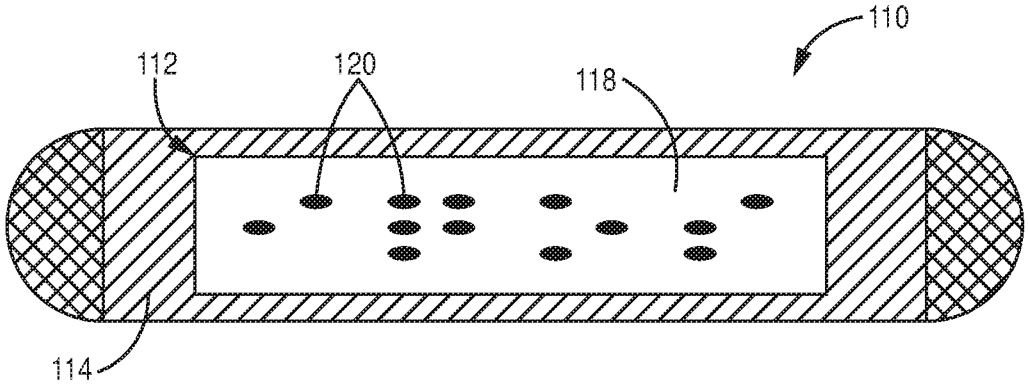
FIG. 8 is a schematic diagram of a cover for a device-holder portion of a charging case with an inserted tactile display.

The cover depicted in FIG. 8 illustrates a cover 110 that may have an opening 112 at a top surface 114 that may allow a user to touch a surface 118 of electronics that may be inserted in the cover 110. The opening 112 may have a smaller area than the electronics in order to ensure a tight seating and to prevent the electronics from sliding through the opening. The surface 118 of the electronics may have a matrix of moveable pins 120. Said moveable pins 120 can be moved upwards to create an elevation that a user can perceive through touch.

Figure 9:
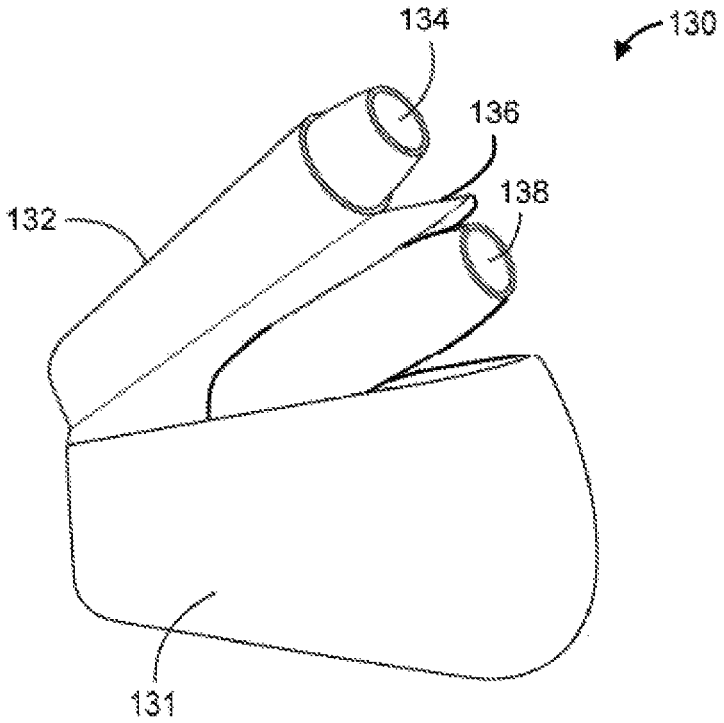
FIG. 9 is a schematic diagram of a charging case in an open position with a cover for a device-holder portion of a charging case with a storage portion for an aerosol-generating device.

The charging case depicted in FIG. 9 illustrates a charging case 130 in an open position that may include a housing 131, a device-holder portion 136, a first aerosol-generating device 138, and a cover 132 that may include a storage portion for storing a second aerosol-generating device 134. The aerosol-generating device 134 may be slidably received into the storage portion of the cover 132. To protect the aerosol-generating device from being exposed to dust and other contaminants, the aerosol-generating device may be inserted "upside-down." In other words, the aerosol-generating device may be inserted with the end of the aerosol-generating device with the opening for aerosol generating articles down into the storage portion or slot, thus leaving a connector end at an open top end of storage portion. The cover 132 may be retained to an external wall of a charging case 130. In one embodiment, the cover 132 may be releasably retained or releasably attached to the external wall of the device-holder portion 136.

In one embodiment, the cover 132 may be fixed to the external wall of a device-holder portion of the charging case 130. In other words, the cover 132 may be integrally formed with the device-holder portion 136. In this embodiment, the cover 132 may not be releasably retained to the charging case 130.

Figure 10:
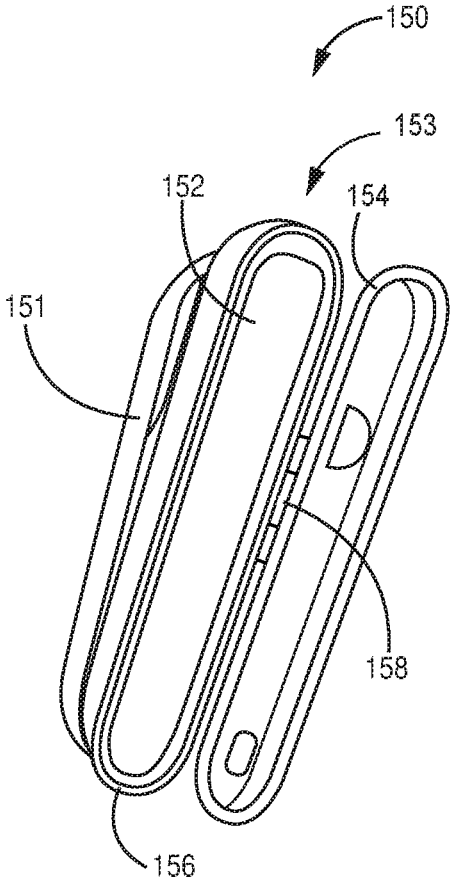
FIGS. 10 and 11 are schematic diagrams of another charging case with a cover for a device-holder portion of a charging case with a storage portion for an aerosol-generating device.
Figure 11:
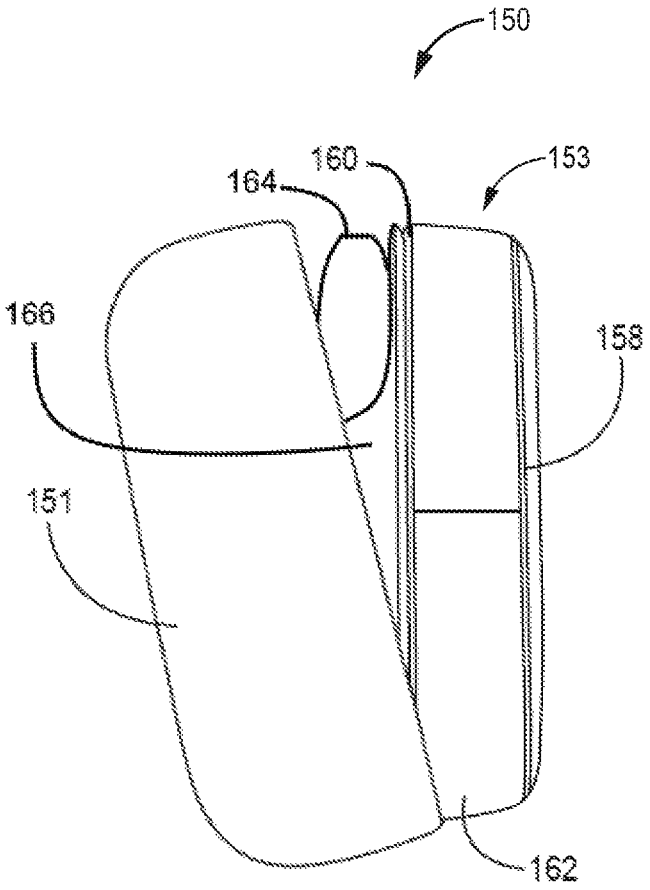

The charging device depicted in FIGS. 10 and 11 illustrates a charging device 150 including a housing 151 and a cover 153 that may include a storage portion 152 and that may include a lid 154. Additionally, the charging device 150 may include a device-holder portion 166 that may contain an aerosol-generating device 164 as depicted in FIG. 11 with the charging device in an open position. The lid 154 may have an open position as depicted in FIG. 10 and a closed position as depicted in FIG. 11. The lid 154 may be configured to expose a storage volume 156 defined by the storage portion 152 when in the open position. The lid 154 may be configured to cover the storage volume 156 when in the closed position. The lid 154 may be configured to pivot between the open position and the closed position. The cover may further include a hinge 158. Additionally, the lid 154 may be configured to pivot about the hinge 158.

The storage portion 152 may further include a bottom wall 160 and one or more side walls 162 extending from a surface of the bottom wall. The lid 154 may be coupled to the one or more side walls such that the storage volume 156 is defined between the bottom wall 160, the one or more side walls 162, and the lid 154 when the lid is in the closed position. The lid 154 may be coupled to the one or more side walls 162 via the hinge 158. The lid 154 may be replaceable or interchangeable.

The storage portion 152 may be configured to hold or receive an aerosol-generating device, aerosol-generating articles, accessories, for example. The storage portion 152 may enable the charging case 150 to store a second aerosol-generating device in addition to aerosol-generating device 164. Additionally, holding two aerosol-generating devices may enable the charging case to charge both aerosol-generating devices. Alternatively, the storage portion 152 may be configured to store a power-bank for carrying extra energy to give an attached charging case additional energy storage or to recharge the charging case.

Although the examples of a cover provided herein depict examples comprising two couplers, the invention as described herein may comprise a single coupler to releasably retain the cover to a charging case. The use of additional couplers, for example, two or more couplers may help to retain the position of the cover on the charging case.

The exemplary embodiments described above are not limiting. Other embodiments consistent with the exemplary embodiments described above will be apparent to those skilled in the art.

The invention claimed is:

1. A charging case for receiving and charging an aerosol-generating device, the case comprising:

a housing having an opening;

a device-holder portion moveably coupled to the housing and movable relative to the housing between an open position and a closed position, the device-holder portion comprising an external wall and one or more internal walls arranged to releasably hold an aerosol-generating device; and a cover comprising a storage portion defining a storage volume for storing at least one item, wherein the cover is releasably retained to the external wall, wherein the cover resides outside of the housing of the charging case when coupled to the device-holder portion.

2. A kit comprising:

a charging case for receiving and charging an aerosol-generating device, the case comprising:

a housing having an opening;

a device-holder portion movably coupled to the housing and movable relative to the housing between an open position and a closed position, the device-holder portion comprising an external wall and one or more internal walls arranged to releasably hold an aerosol-generating device; and a cover, comprising:

a coupler configured to releasably retain the cover to the external wall of the device-holder portion; and a storage portion defining a storage volume in the cover for storing at least one item, wherein the storage portion is outside of the charging case when releasably retained to the external wall of the device-holder portion.

3. A kit according to claim 2, further comprising one or more aerosol-generating devices.

4. The charging case according to claim 1, wherein the storage portion is configured to receive and store an aerosol-generating device.

5. The charging case according to claim 1, wherein the cover further comprises:

an open end configured to receive at least a portion of an aerosol-generating device into the storage portion.

6. The charging case according to claim 1, wherein the cover is configured to electrically charge an aerosol-generating device received in the storage portion.

7. The charging case according to claim 1, wherein the cover is electrically coupled to the charging case.

8. The charging case according to claim 4, wherein the device holder portion is configured to charge an aerosol-generating device and the storage portion is configured to charge a second aerosol-generating device.

9. A kit according to claim 2, wherein the storage portion is configured to receive and store an aerosol-generating device within the storage volume.

10. A kit according to claim 2, wherein the cover comprises a lid having an open position and a closed position, wherein the lid is configured to expose the storage volume when in the open position; and wherein the lid is configured to cover the storage volume in the closed position.

11. A kit according to claim 2, wherein the storage portion is configured to receive electronic circuitry.

12. A kit according to claim 2, wherein the cover further comprises an at least partially transparent wall adjacent the storage portion; and wherein the storage portion is configured to receive a visual display.

13. A kit according to claim 2, wherein the storage portion is configured to receive a tactile display.

14. A kit according to claim 2, wherein the storage portion is configured to receive at least one aerosol-generating article or at least one aerosol-generating device accessory.

15. A kit according to claim 2, wherein the coupler comprises a first magnetic coupler and a second magnetic coupler offset at a distance from one another.

16. A kit according to claim 15, wherein a distance between a center of the first magnetic coupler and a center of the second magnetic coupler is about 60 mm to 70 mm.

17. A kit according to claim 2, wherein the storage portion comprises a storage volume in the cover having at least one of a width of at least about 10 mm to 20 mm, a length of at least about 90 mm to 100 mm, and a depth of at least about 10 mm to 20 mm.

18. A kit according to claim 2, wherein the cover further comprises:

an open end configured to receive at least a portion of an aerosol-generating device into the storage portion.

19. A kit according to claim 18, wherein the cover further comprises:

a closed portion configured to releasably hold the at least a portion of the aerosol-generating device when received in the storage portion.

* * * * *